US007898496B2

(12) United States Patent
Olsen et al.

(10) Patent No.: US 7,898,496 B2
(45) Date of Patent: Mar. 1, 2011

(54) ANTENNA MOUNT WITH ALTERNATIVE USES

(76) Inventors: Eric Olsen, Corpus Christi, TX (US); Clifton Darling, Corpuu Christi, TX (US)

( * ) Notice: Subject to any disclaimer, the term of this patent is extended or adjusted under 35 U.S.C. 154(b) by 354 days.

(21) Appl. No.: 11/809,999

(22) Filed: Jun. 4, 2007

(65) Prior Publication Data

US 2007/0279308 A1 Dec. 6, 2007

Related U.S. Application Data

(60) Provisional application No. 60/810,932, filed on Jun. 5, 2006.

(51) Int. Cl.
*H01Q 1/42* (2006.01)

(52) U.S. Cl. ..... 343/878; 343/713

(58) Field of Classification Search ..... 343/713, 343/878, 880, 881, 892
See application file for complete search history.

(56) References Cited

U.S. PATENT DOCUMENTS

| | | | | | |
|---|---|---|---|---|---|
| 2,250,387 | A | * | 7/1941 | McDonald, Jr. | 343/870 |
| 3,281,847 | A | * | 10/1966 | Gil De Gibaja Herrero | 343/702 |
| 3,442,476 | A | * | 5/1969 | Trimble | 248/537 |
| 3,729,741 | A | * | 4/1973 | Otto | 343/713 |
| 5,746,567 | A | * | 5/1998 | Herbermann et al. | 414/749.6 |

* cited by examiner

*Primary Examiner* — Tho G Phan
(74) *Attorney, Agent, or Firm* — George A. Giles

(57) ABSTRACT

An apparatus for holding an antenna on a mounting surface by use of suction cups or suction devices such that the antenna may be temporarily removed from the surface and subsequently restored or relocated to another mounting surface. The suction cups or suction devices are mechanically connected to an support arm capable of adjustment for permitting either vertical or horizontal modification of the holding arm thereby maintaining a constant mounting angle of the holding arm for surfaces having various mounting directions or planes. By maintaining a fixed vertical of the holding arm from various mounting points, the directional alignment of the antenna, such as for a dish-type antenna, can remain relatively consistent from one installation to the next.

16 Claims, 4 Drawing Sheets

ANTENNA MOUNT WITH ALTERNATIVE USES

CROSS-REFERENCES TO RELATED APPLICATIONS

This application claims the benefit of priority of U.S. Provisional Application No. 60/810,932, filed Jun. 5, 2006, entitled ANTENNA MOUNT naming Eric Olsen and Wiley Darling as the inventors. The contents of the provisional application are incorporated herein by reference in their entirety.

STATEMENT REGARDING FEDERALLY SPONSORED RESEARCH OR DEVELOPMENT

Not applicable.

BACKGROUND OF THE INVENTION

1. Field of the Invention

The invention relates to the field of apparatus for mounting an antenna on a surface, in particular for mounting and removing the antenna for transport or relocation, which can advantageously be used in areas of concern involving the use of an antenna in motorized-vehicles or mobile homes or where the antenna is employed in a portable manner.

Further, the invention relates to the field for mounting an object on a surface, in particular for temporarily mounting and subsequently removing the object or assembly attached from the surface.

2. Description of Related Art

The average size or diameter of satellite antennas or dishes have reduced over the years. Satellite dishes of diameter of only 20 inches or less are now more common. With the reduction in size, the dishes have more prevalent in industries such as the trucking industry or in the recreational vehicle industry. Smaller satellite dishes permit reception of entertainment signals in a more mobile environment.

Various methods have been employed in the past, including tripod configurations and fixed configurations.

BRIEF SUMMARY OF THE INVENTION

The invention is an apparatus for mounting a satellite dish type antenna on a mounting surface capable of holding by use of suction device(s). In combination, a a mounting bracket, a support arm and the suction device(s) form a simple to use, semi-permanent holding apparatus for a satellite dish type antenna, various other types of antennas, a sign, or other devices such as flag poles, small tables or shelves, or the like.

An object is achieved in an simple manner by using a modified deformation device comprising suction device(s) or suction cup(s) previously typically used for handling materials, e.g., sheets of glass, and attaching a bracket assembly to the modified deformation device, wherein the bracket assembly is used for attaching an antenna assembly or another device such as a flag pole or sign or small shelf or the like.

The suction device(s) used with the preferred embodiment of the invention incorporate a lever in their design which moves a portion of the inner surface of the suction device thereby increasing the suction force adhering the suction device to the surface.

The invention is useful for holding and for positioning a variety of light weight articles, including but not limited to various antenna assemblies, a flag pole, a sign, or a small shelf.

The invention is useful in that it may be attached and removed from a mounting surface and the entire structure can be easily relocated or stored. Storing is particularly useful in its preferred embodiment wherein a satellite dish style antenna is attached, and the invention is subsequently removed from the mounting surface of motor home or vehicle for relocation of either the motor home or other vehicle or removed from the attached assembly.

Those involved in the recreational vehicle (RV) industry and over the road trucking industry are benefited because setup and removal is easily achieved.

Those involved in living in a multi-unit building such as an apartment complex or condominium or high rise are benefited because setup is not necessarily permanent and may be done on a vertical surface wherein the suction device(s) or suction cup(s) can be attached.

Others may be benefited merely because the invention may be temporarily attached to a mounting surface and subsequently removed from that surface, depending upon the particular device or assembly attached to the invention, for example, a satellite dish type antenna or a flag pole displaying a flag.

It is aspect of the invention to provide a releasable mounting apparatus that can be mounted without the use of screws, bolts, or other fasteners which necessitate using holes in the mounting surface.

It is another aspect of the invention to provide a releasable satellite dish mounting apparatus that is inexpensive to manufacture and be easily fabricated with readily available components.

Still another aspect of the invention is to provide a releasable satellite dish mounting apparatus that be installed on the outside of a motor home or recreational vehicle which then can be removed and stored prior to relocation of the motor home or recreational vehicle.

BRIEF DESCRIPTION OF THE DRAWINGS

The invention, explained in more detail below, and with reference to the attached drawings, in which.

DETAILED DESCRIPTION OF THE INVENTION

Figure 1:
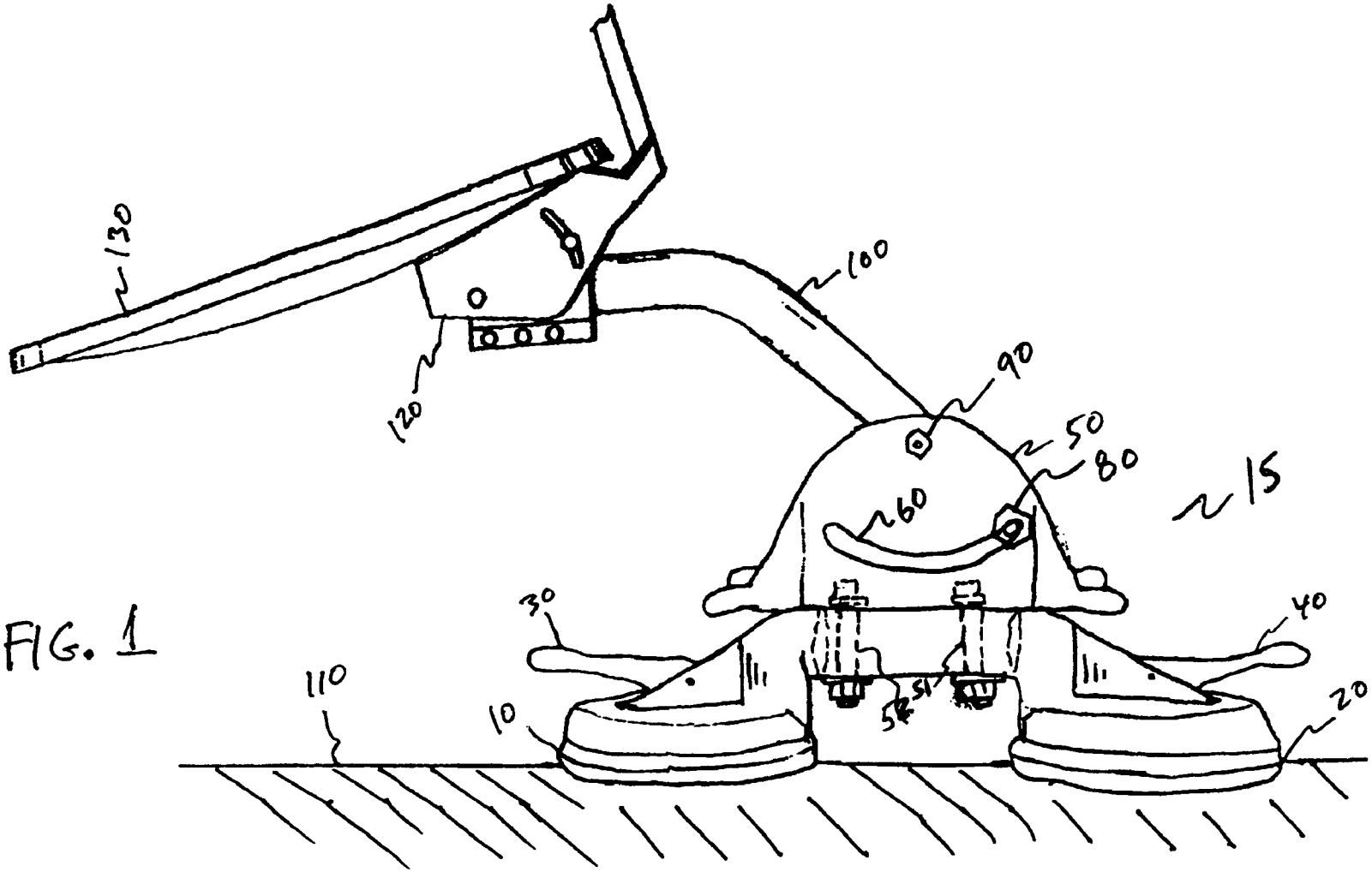
FIG. 1 shows an illustration from a side view of the preferred embodiment according to the invention.

Referring now to the drawing for a better understanding of the invention, and as shown in FIG. 1, invention 15 is attached to a mounting surface 110 using suction devices 10 and 20. Attached to support arm 100 is satellite dish 130 by satellite holding bracket 120. Satellite holding bracket 120 can be supplied with the particular make or model of satellite dish 130 or typically can be acquired as an off-the-shelf type part. As shown, support arm 100 is angled and tubular in design, however, support arm 100 need only connect or attach satellite holding bracket 120 with mounting bracket 50.

Figure 3:
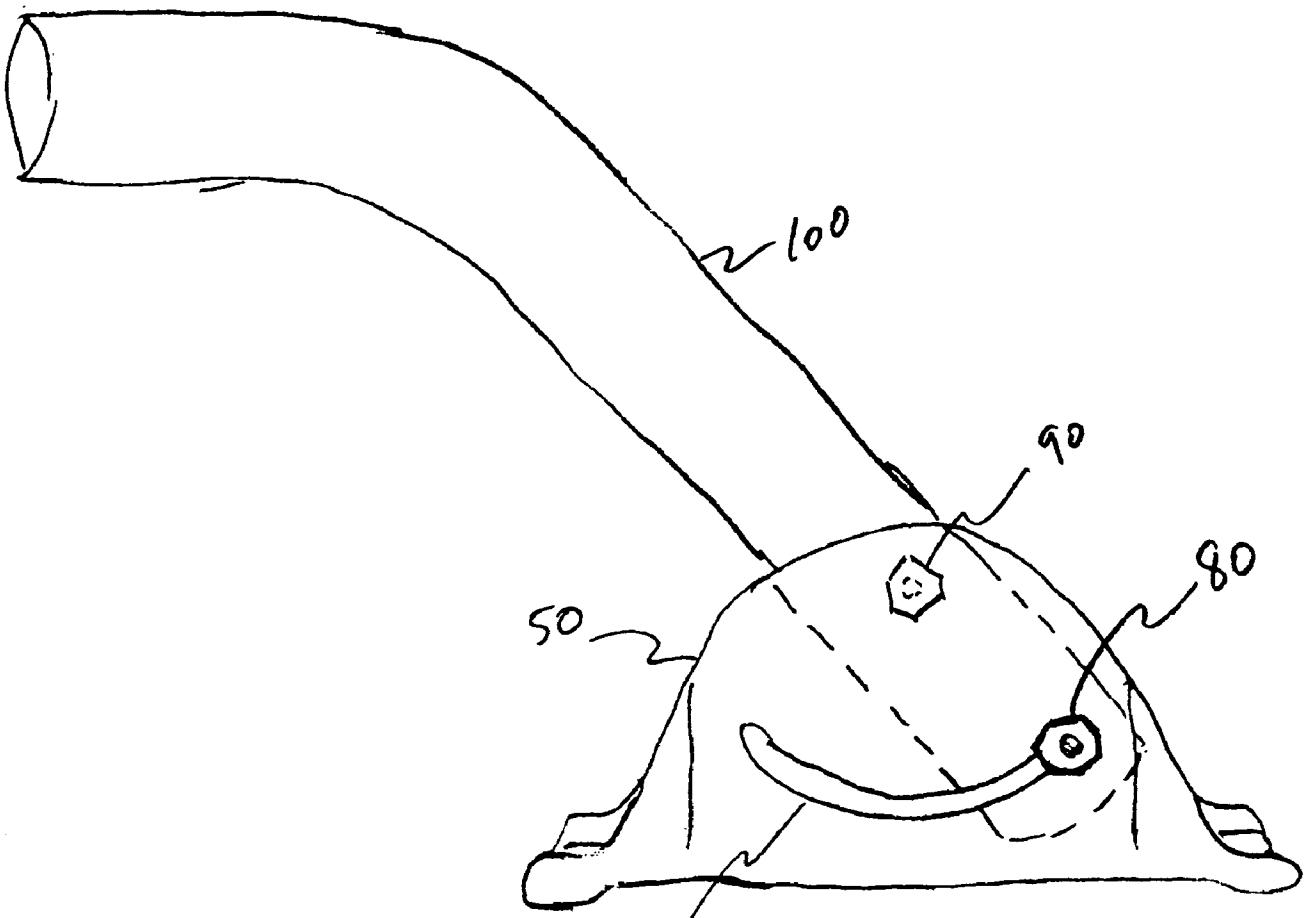
FIG. 3 PRIOR ART
FIG. 3 shows, from the side, a view of a preexisting bracket and arm assembly used in mounting satellite dishes.

Referring now to FIG. 3, Support arm 100 pivots around fastener 90 in such a manner as to permit the end of support arm 100 to rotate in the arc described by slot 60. Support arm 100 is held in a fixed angular place by fastener 80, which is further described as a bolt in combination with a nut.

Support arm 100 in combination with mounting bracket 50 are well known in the art of satellite dish mounting hardware, and can be purchased as an off-the-shelf item. A typical off the shelf item such as support arm 100 and mounting bracket 50 are made from metal. Other materials such as plastic could be used.

Figure 2:
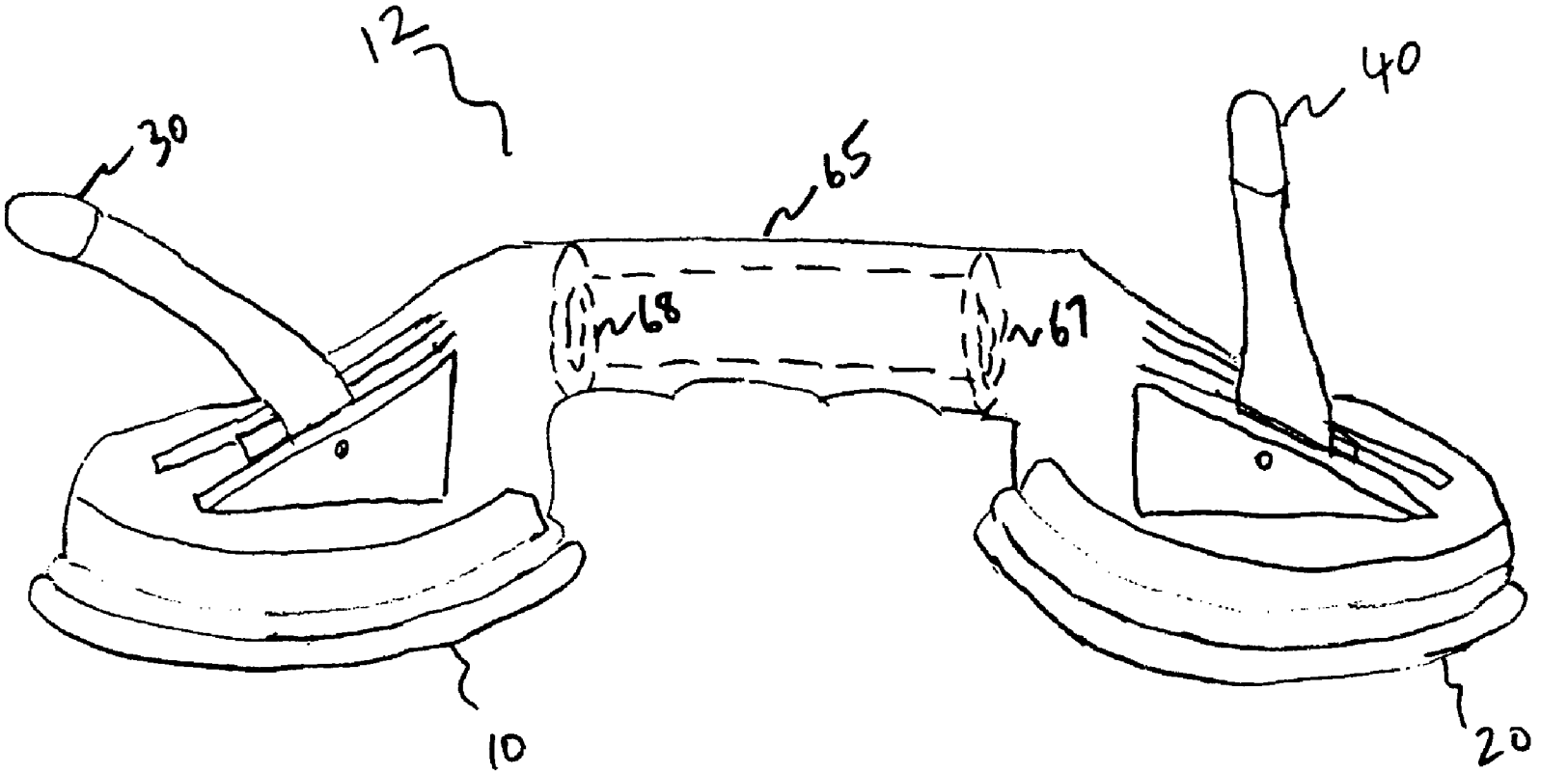
FIG. 2 PRIOR ART
FIG. 2 shows, in an illustration and obliquely from the side, a preexisting handle assemble used in moving certain materials such as glass panes.

Now referring to FIG. 2, likewise, Dual Suction cup device 12 is an off-the-shelf item. Dual Suction cup device 12 comprises a handle area 65 which is connected to suction cups 10 and 20 using molded plastic or the like. Suction cups 10 and 20 are made more secure to mounting surface 110 by changing the position of levers 30 and 40, respectfully, as is well known in the art of suction devices. Dual Suction cup device 12 may be manufactured by GORDON, and is made from plastic(s). As so manufactured, handle area 65 is hollowed out between end points 67 and 68.

Figure 4:
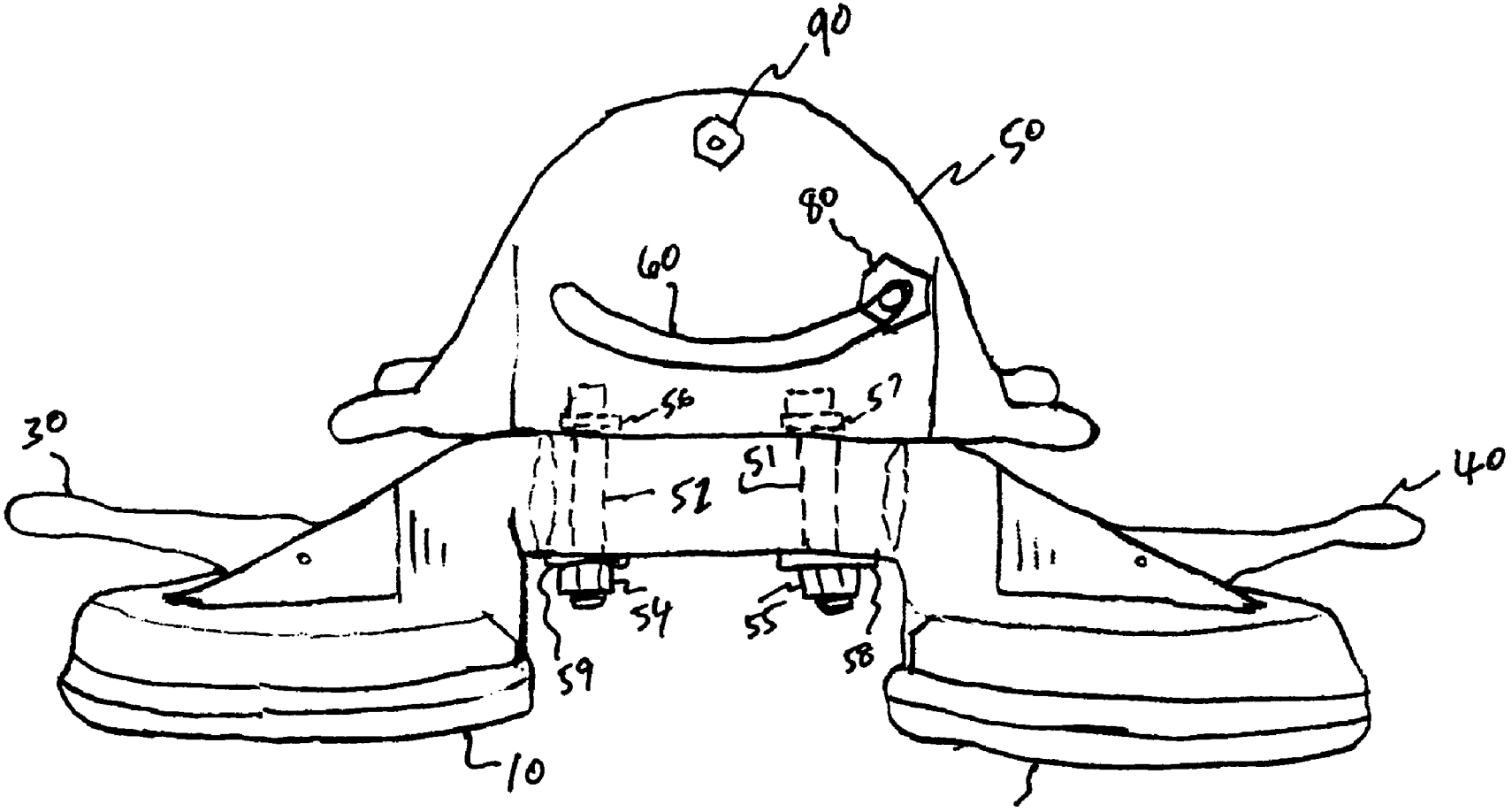
FIG. 4 shows, from the side, a view of the bracket attached to the handle assembly.

Referring next to FIG. 4, it shows mounting bracket 50 attached to Dual Suction cup device 12 using bolts 51 and 52, and washers 56, 57, 58 and 59. Bolts 51 and 52 are held in place by nuts 54 and 55, respectfully. In the preferred embodiment, handle plugs (not shown) are inserted into end points 67 and 68 such that bolts 51 and 52 are supported through the entire diameter of handle area 65. Typically, the handle plugs will made from a round material such as wood dowel, cut to length, painted or sealed, and inserted through end points 67 and 68 to provide for additional strength to handle area 65.

Mounting bracket 50 attaches to handle area 65 using two bolts 51 and 52 through holes implemented in handle area 65 and, if inserted, holes the handle plugs.

Now referring back to FIG. 1, mounting bracket 50 attached to modified Dual Suction cup device 12, in combination with support arm 100, create a simple to use and readily assembled satellite antenna mount system capable of being placed onto and then removed from and replaced onto mounting surface 110, or another mounting surface. By releasing levers 30 and 40 such that the suction previously created when levers 30 and 40 were positioned for holding, the mounting system can be released and removed from the mounting surface. In so doing, a semi-permanent attachment to mounting surface 110 has been created for holding items such as satellite dish 130.

As shown in FIG. 1, mounting surface 110 can be in the vertical direction. Satellite dish 130 points in an upward direction. However, if mounting surface 110 was in a horizontal direction, then fastener 80 could be loosened and support arm 100 pivoted around fastener 90 in such a way around the arc of slot 60 such that satellite dish 130 now points in an upward direction while being mounted on a mounting surface 110 which is generally in a horizontal position. Mounting surfaces between horizontal and vertical simply require an adjustment of fastener 90 in slot 60, thereby keeping support arm 100 in a particular plane determined by slot 60 and mounting bracket 50. Therefore, any sufficiently stable mounting surface 110 capable of holding suction cups 10 and 20 (and the weight associated with the attached device) is likely to be suitable as a mounting area. This allows great flexibility in where the satellite mounting system is deployed, and is not limited to mobile homes or recreational vehicles. By maintaining a fixed vertical of the holding arm from various mounting points, the directional alignment of the antenna, such as for a dish-type antenna, can remain relatively consistent from one installation to the next.

In addition, satellite dish 130 and satellite holding bracket 120 can be removed from support arm 100 and stored. Other components could be attached to the satellite mount system, including but not limited to flag pole holding assembly, a small table or shelf, or virtually anything of limited weight that could attach to support arm 100. As such, this mount system provides multiple uses for semi-permanently attaching any device assemble of suitable weight to a mounting surface.

It should be noted that many variations may be provided within the scope of the present invention, and that the preferred embodiment has been disclosed.

It is to be understood that the invention is not limited to the illustrations described and shown herein, which are deemed to be merely illustrative of the best modes of carrying out the invention, and which are susceptible of modification of form, size, arrangement of parts and certain details of operation. The invention rather is intended to encompass all such modifications which are within its spirit and scope as defined by the claims.

What is claimed is:

1. A mounting system for an attached device comprising:

at least one suction cup for attaching the mounting system to a surface wherein the suction cup is connected to a handle area; and, an arm assembly further comprising a mounting bracket and a support arm capable of rotation between horizontal and vertical and in a fixed plane, wherein the mounting bracket permits alignment of the support arm in the fixed plane, and wherein the mounting bracket is connected to the handle area and wherein the attached device is connected to the support arm.

2. The system according to claim 1, wherein at least one suction cup has increased suction activated by a lever.

3. The system according to claim 1, wherein the attached device is a flag pole.

4. The system according to claim 1, wherein the attached device is a table or shelf.

5. The system according to claim 1, wherein the attached device is a sign.

6. A mounting system for an antenna comprising:

at least one suction cup for attaching the mounting system to a surface wherein the suction cup is connected to a handle area; and, an arm assembly further comprising a mounting bracket and a support arm capable of rotation between horizontal and vertical and in a fixed plane, wherein the mounting bracket permits alignment of the support arm in the fixed plane, and wherein the mounting bracket is connected to the handle area and wherein the antenna is connected to the support arm.

7. The system according to claim 6, wherein the antenna is a dish type antenna.

8. The system according to claim 7, wherein the number of suction cups is two.

9. The system according to claim 8, wherein the suction cups are capable of being attached to a vertical mounting surface and where the antenna points upwardly.

10. The system according to claim 9, wherein the vertical mounting surface is attached to a motor home or recreational vehicle or other motorized vehicle.

11. The system according to claim 9, wherein the vertical mounting surface is attached to an exterior structure of apartment complex or condominium.

12. The system according to claim 8, wherein the suction cups are capable of being attached to a horizontal mounting surface and where the antenna points upwardly.

13. The system according to claim 12, wherein the horizontal mounting surface is attached to a motor home or recreational vehicle or other motorized vehicle.

14. The system according to claim 8, wherein the antenna is replaced by a flag pole.

15. The system according to claim 8, wherein the antenna is replaced by a table or shelf.

16. The system according to claim 8, wherein the antenna is replaced by a sign.

* * * * *